US007300051B1

(12) United States Patent
Rieschick

(10) Patent No.: US 7,300,051 B1
(45) Date of Patent: Nov. 27, 2007

(54) RIPPLER FOR A PAPER DELIVERER

(75) Inventor: David L. Rieschick, Sabetha, KS (US)

(73) Assignee: Stolle Machinery Company, LLC, Centennial, CO (US)

( * ) Notice: Subject to any disclaimer, the term of this patent is extended or adjusted under 35 U.S.C. 154(b) by 399 days.

(21) Appl. No.: 10/693,530

(22) Filed: Oct. 24, 2003

(51) Int. Cl.
*B65H 29/70* (2006.01)

(52) U.S. Cl. ..... 271/188; 271/12; 271/276; 271/197; 271/209

(58) Field of Classification Search ..... 271/11, 271/12, 94, 276, 264, 188, 69, 196, 197, 271/209, 161, 194
See application file for complete search history.

(56) References Cited

U.S. PATENT DOCUMENTS 2,783,043 A * 2/1957 Tomlin ..... 271/188
4,295,737 A * 10/1981 Silverberg ..... 355/76
4,373,848 A * 2/1983 Bishop ..... 414/403
4,466,607 A * 8/1984 Clark et al. ..... 271/225
5,194,904 A * 3/1993 Ruch ..... 399/397
5,566,933 A * 10/1996 Salancy ..... 271/273
6,494,452 B1 * 12/2002 Karasiewicz ..... 271/276
6,701,841 B2 * 3/2004 Tsurumaki ..... 101/419
2002/0121738 A1 * 9/2002 Slocum et al. ..... 271/273

* cited by examiner

*Primary Examiner*—Patrick Mackey
*Assistant Examiner*—Thomas Morrison
(74) *Attorney, Agent, or Firm*—David P. Maivald; Eckert Seamans Cherin & Mellott, LLC

(57) ABSTRACT

A rippler may be installed on a paper deliverer used in conjunction with a paper sheeter, in between the vacuum belts of the sheeter. The rippler includes an upwardly projecting ridge, causing paper passing over it to develop a ripple, thereby increasing the rigidity of the paper. This increased rigidity of the paper resists the tendency of the paper to fly upward as it is being transported by the deliverer.

14 Claims, 4 Drawing Sheets

RIPPLER FOR A PAPER DELIVERER

FIELD OF THE INVENTION

The present invention relates to paper deliverers used in conjunction with paper sheeters. More specifically, the invention provides an improved deliverer including a means for creating a ripple within the paper, thereby enhancing the rigidity of light-weight papers.

BACKGROUND OF THE INVENTION

After printing is performed on paper, it is next delivered to a sheeter which cuts the paper into sheets, and then to a deliverer, which retards the speed of the individual sheets and then transports the individual sheets of paper to a stacker. Delivering light-weight paper, such as pharmaceutical paper, is difficult because the paper has very little rigidity. Most typical deliverers use a combination of pulleys and wheels and belts to control the paper. This method often causes the paper to buckle, jamming the delivery unit.

As an alternative to belts, a vacuum sheeter uses a plurality of vacuum belts disposed between a pair of pulleys, having a vacuum chamber directly beneath their top surface, and a plurality of apertures within the belts in communication with the vacuum chamber, to control the paper. A first set of vacuum belts delivers the paper from the sheeter at a high speed. A vacuum roller is located at the end of the vacuum belts. The vacuum roller includes a plurality of rows of apertures, with each row being substantially parallel to the longitudinal axis of the cylinder. The holes are in communication with the hollow interior of the cylinder, which in turn is in communication with a vacuum system. Each row corresponds to the stop position for one sheet. A second set of vacuum belts, similar to the first set but moving at a slower speed, is located after the vacuum roller, and may use the vacuum roller as one of its pulleys. The individual paper sheets are carried out of the sheeter at a high speed by the first set of vacuum belts, where they are stopped by the vacuum roller. Each set of holes on the vacuum roller will stop the trailing edge of one sheet, before the cylinder indexes to the next position to stop the next sheet. The sheets are thereby stacked, and the second set of vacuum belts carries them to their next destination.

Although the vacuum sheeter eliminates the jamming problem, it tends to cause light-weight paper to rise into the air as air gets caught underneath the paper. The speed at which the sheeter can be operated is limited by the tendency of the lead edge of the paper to fly up.

Accordingly, there is a need for an improved deliverer including a means for preventing the leading edge of the paper from flying up as it exits the sheeter. Additionally, there is a need for an improved deliverer which avoids the jamming problems of other types of deliverers. There is a further need for a deliverer capable of running at high speed, thereby maximizing it productivity and reducing the overall costs of printing, cutting, and stacking the paper.

SUMMARY OF THE INVENTION

The present invention provides a rippler for use with the deliverer of a vacuum sheeter for paper. As explained below, the rippler meets the above needs by permitting the vacuum deliverer to be operated at higher speeds while resisting the tendency of paper therewithin to fly upward.

A typical vacuum sheeter includes a first set of vacuum belts. The vacuum belts have a plurality of holes along their length, and are stretched between a pair of pulleys. A vacuum chamber is located directly beneath the belts, in communication with the holes. After paper is printed within a printing press and cut within the sheeter, it is removed from the sheeter along these first vacuum belts, with the reduced pressure within the vacuum chamber holding the paper against the belts as the belts advance.

A vacuum roller is located immediately after the first vacuum belts. The hollow vacuum roller includes a plurality of rows of holes, with each row of holes being substantially parallel to the axis of the vacuum roller. Each of the holes is in communication with the hollow interior of the vacuum roller. The vacuum roller includes means for rotating the roller, and means for applying a vacuum force to the inside of the cylinder. As a sheet of paper passes over the vacuum roller, the rapid forward progress of the paper, caused by the first set of vacuum belts, will be arrested by one row of apertures catching the trailing edge of the paper. The paper's forward progress will be arrested when it substantially overlaps the preceding sheet of paper, with only the trailing edge protruding from the previous sheet. The paper is then transported by a second set of belts, stretched between the vacuum roller and another pulley, at a slower speed. Each row of holes within the vacuum roller corresponds to the stopping point for one sheet of paper.

In a prior art vacuum deliverer, the leading edge of light-weight papers, such as pharmaceutical papers, will tend to fly up while being carried by the first set of vacuum belts at a high rate of speed, onto the second set of belts. To prevent this, a rippler of the present invention is provided between at least some of the first vacuum belts. The rippler is an elongated member having a leading end and a trailing end. The leading end includes a hook for securing the rippler to a plate between the vacuum belts. The trailing edge includes an upwardly projecting ridge, causing the paper to develop a ripple as it passes over the ridge. This ripple increases the rigidity of the paper, reducing its tendency to fly up.

It is therefore an object of the present invention to provide a means of preventing light-weight paper from flying up when delivered using a vacuum deliverer.

It is another object of the present invention to provide an apparatus for causing paper being transported through a deliverer to form a ripple, thereby increasing its rigidity and reducing its tendency to fly upward during transport.

It is a further object of the present invention to provide a rippler that may be utilized with presently existing vacuum deliverers.

It is another object of the present invention to provide a deliverer capable of operating at higher speed without paper flying up, and without jamming, thereby increasing the productivity of the sheeter to which the deliverer is secured.

It is a further object of the present invention to provide a method of resisting the tendency of a lightweight paper to fly upward while being transported.

These and other objects of the invention will become apparent through the following description and drawings.

BRIEF DESCRIPTION OF THE DRAWINGS

Like reference characters denote like elements throughout the drawings.

DETAILED DESCRIPTION OF PREFERRED EMBODIMENTS

The present invention provides a rippler to be used in conjunction with a paper deliverer associated with a paper sheeter, causing the paper to ripple as it passes over the rippler, thereby increasing the rigidity of the paper and decreasing its tendency to fly upward.

Figure 1:
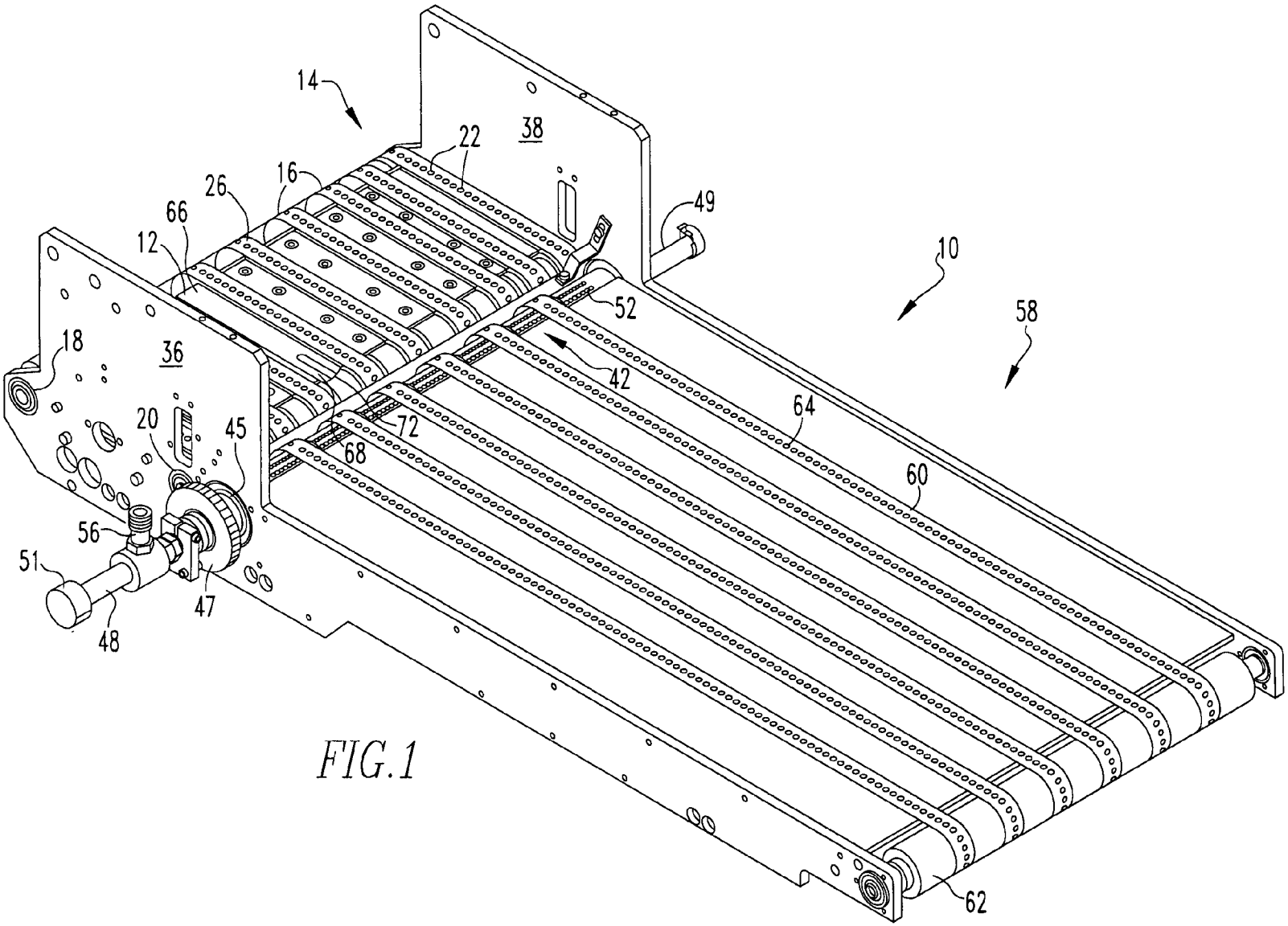
FIG. 1 is a top isometric view of a deliverer using a rippler according to the present invention.
Figure 2:
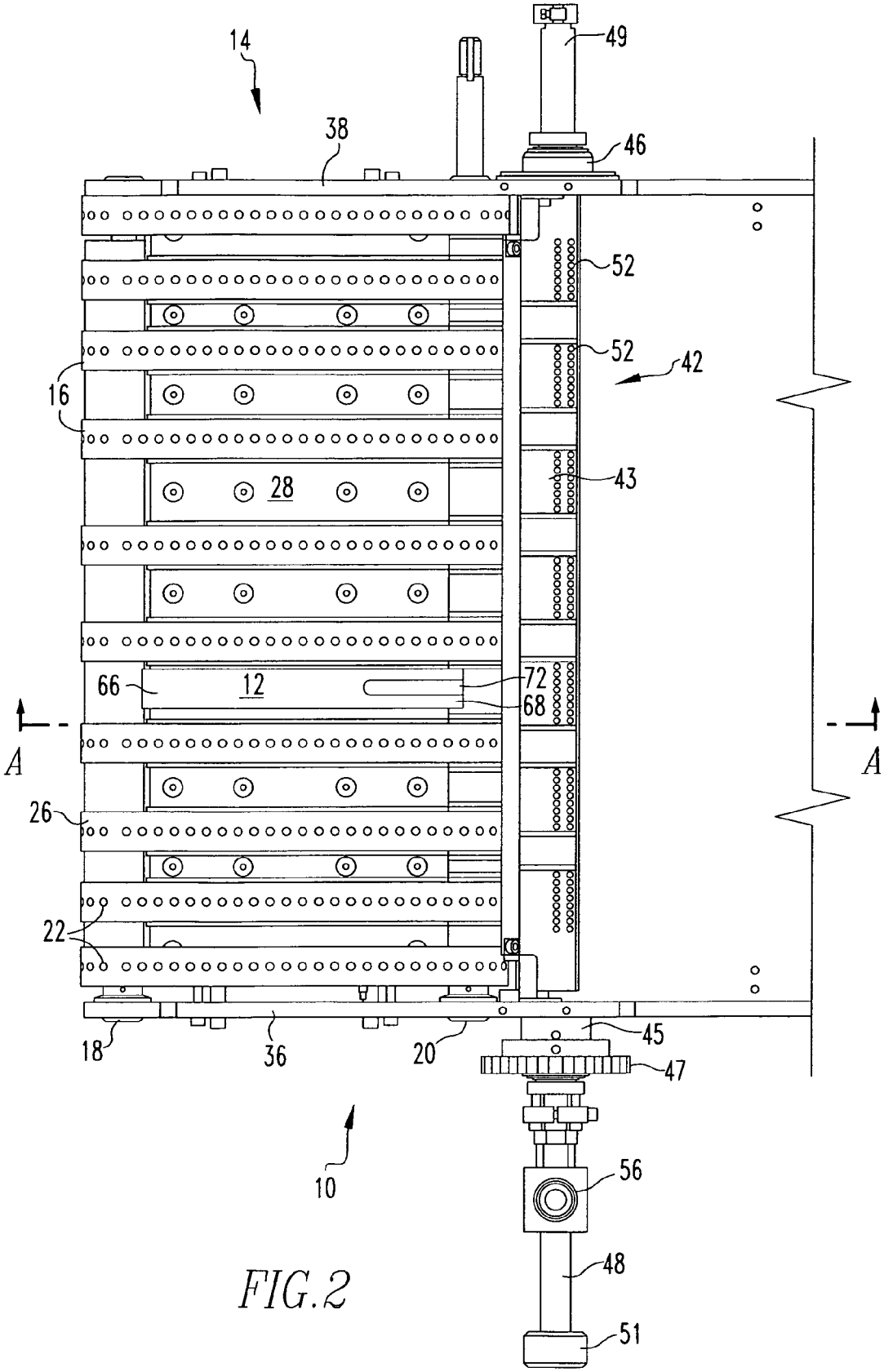
FIG. 2 is a top view of a first vacuum belt section and vacuum roller of a sheeter upon which a rippler of the present invention has been installed.
Figure 3:
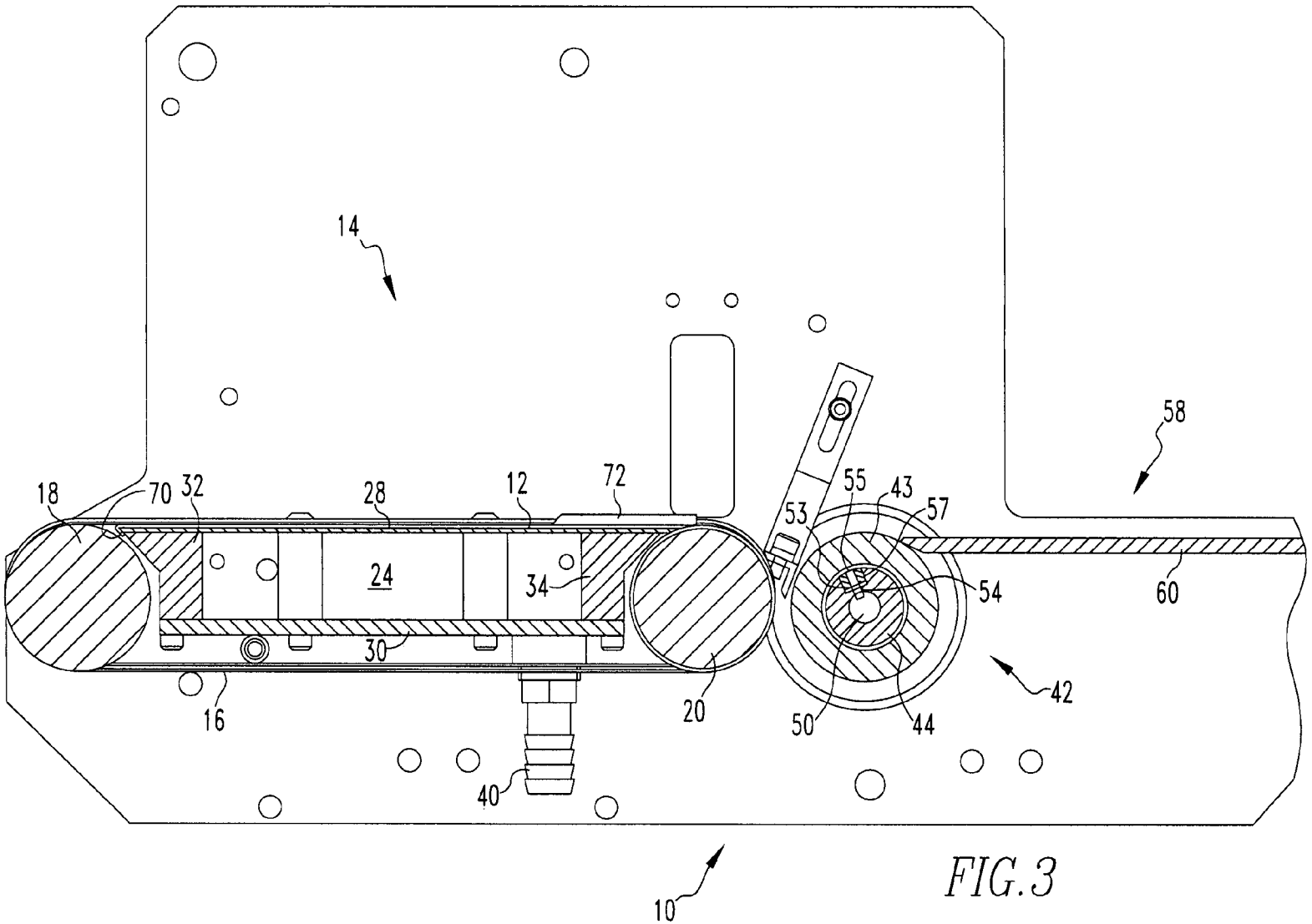
FIG. 3 is a side cross sectional view of the first vacuum pulley section and vacuum roller of the deliverer of FIG. 2, taken along the lines A-A in FIG. 2.

Referring to FIGS. 1-3, a deliverer 10 incorporating a rippler 12 of the present invention is illustrated. The deliverer includes a first vacuum belt section 14 including a plurality of vacuum belts 16. The belts 16 are stretched between a pair of pulleys 18, 20. It will be understood by those skilled in the art that one of the pulleys 18, 20 includes a drive means. Each belt 16 defines a plurality of apertures 22.

Referring to FIG. 3, a vacuum chamber 24 is defined immediately below the top surface 26 of the belts 16. The vacuum chamber 24 is defined within the top plate 28 disposed below the belts 16, bottom plate 30, end plates 32, 34, and side plates 36, 38. A vacuum fitting 40 is in communication with the vacuum chamber 24. In the illustrated embodiment, the vacuum fitting 40 is secured to the bottom plate 30. However, the vacuum fitting 40 may also be secured at other suitable locations. As is well known to those skilled in the art, the vacuum fitting 40 will be in communication with a tube leading to a vacuum generator, for decreasing the air pressure within the vacuum chamber 24. The apertures 22 within the belts 16 are also in communication with the vacuum chamber 24 because the belts 16 are located within slots defined within the top plate 28, so that when the pressure is reduced within the vacuum chamber 24, a suction force is supplied through the holes 22.

Referring back to FIGS. 1-3, a vacuum roller 42 is located immediately adjacent to and substantially parallel to the pulley 20. The vacuum roller 42 is substantially parallel to the pulley 20. The vacuum roller 42 includes an outer roller portion 43 and an inner stationary portion 44. The outer roller portion includes a pair of ends 45,46, and the inner stationary portion includes a pair of ends 48,49. In the illustrated embodiment, the end 45 includes a means for automatically rotating the roller portion 43, which in the illustrated example include the gear 47, which, as is well known to those skilled in the art, operatively connected to an appropriate motor. The stationary portion 44 defines a hollow interior portion 50. The end 48 includes a manual adjustment knob 51. The roller portion 43 is hollow, and defines a plurality of holes 52 along its length. The holes 52 are arranged into rows that are substantially parallel with the longitudinal axis of the roller portion 43. Although as few as one row of holes 52 may be used, a preferred number of rows is four. The stationary portion 44 includes a plurality of apertures 57, with each aperture 57 preferably containing a graphite insert 53, with each graphite insert 53 being biased outward by a spring 54, and defining an aperture 55 therethrough. Each of the inserts 53 is aligned with the corresponding hole 52 when the roller portion 43 is in the point in the rotation when vacuum suction is desired, which in the illustrated example is about at the 11:00 position of FIG. 3. The end 48 of the stationary portion 44 includes a vacuum fitting 56 secured thereto, with the vacuum fitting 56 being in communication with the interior of the stationary portion 44. As is well known to those skilled in the art, the vacuum fitting 56 will be in communication with a tube leading to a vacuum generator, which when activated, will reduce the air pressure within the, stationary portion 44, Because the inserts 53 are sealingly biased against the roller portion 43, a suction will be produced through the holes 52 every time the holes 52 are aligned with the inserts 53. The adjustment knob 51 may be used to set the location of the inserts 53 as desired by rotating the stationary portion 44 to any desired position. It will be recognized that the gear 47 and adjustment knob 51 could be located at ends 46,49 of the vacuum roller 42 without affecting the invention.

A second vacuum belt section 58 follows the vacuum roller 42, and is substantially coplanar with the first vacuum belt section 14. The vacuum belt section 58 includes a plurality of vacuum belts 60 extending from the vacuum roller 42, which serves as a pulley for one end, and the pulley 62 at the opposite end. Each of the vacuum belts 60 defines a plurality of apertures 64 which, although not shown, will be understood by those skilled in the art to be in communication with a vacuum chamber located below the top surface of the belts 60 in the same manner that the apertures 22 are in communication with the vacuum chamber 24. Upon application of the vacuum generator, suction will be created through the holes 64, thereby holding the paper on the belts 60 while the paper is being transported by these belts.

Figure 4:
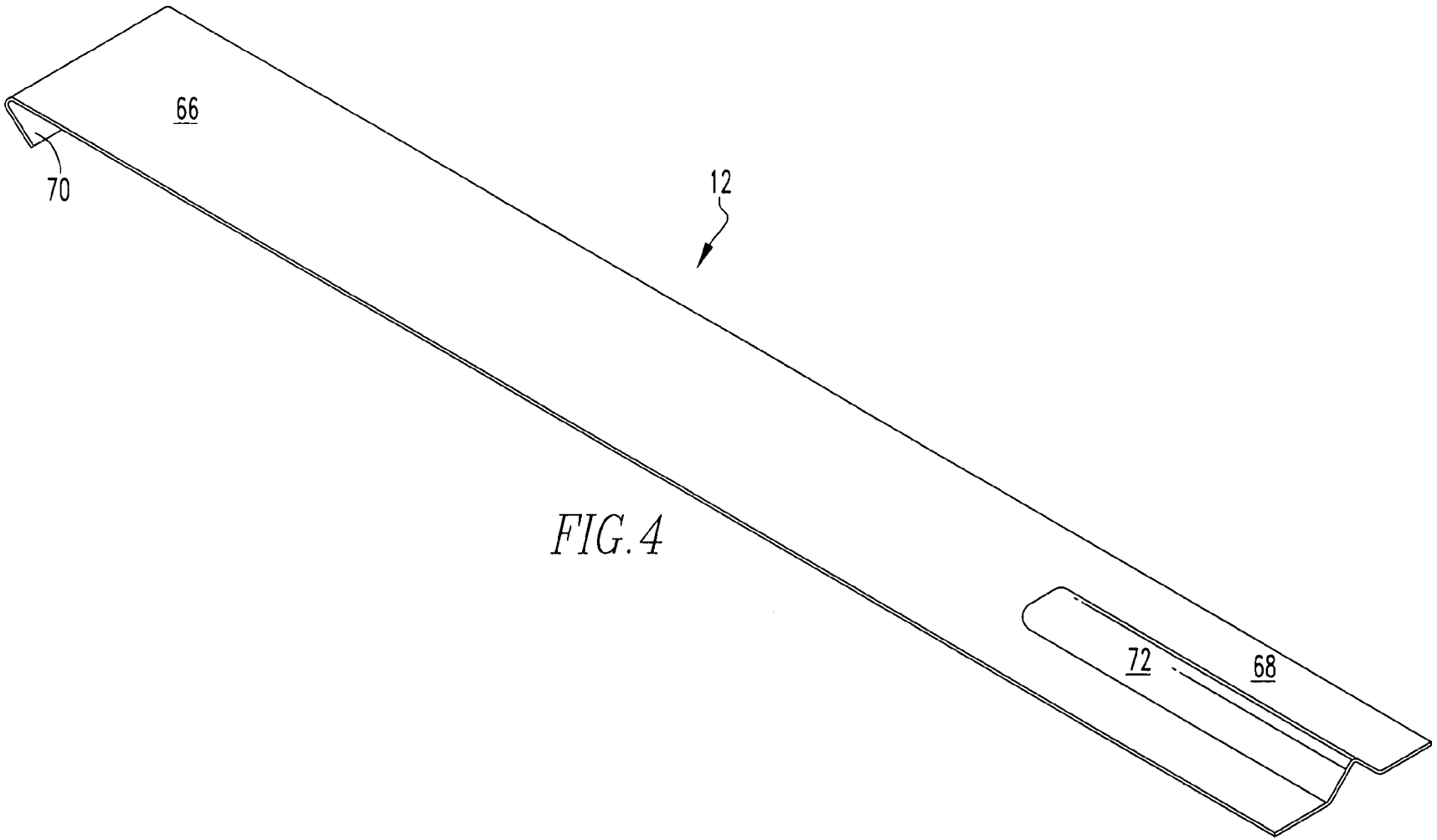
FIG. 4 is a top isometric view of a rippler according to the present invention.

Referring to FIG. 4, a rippler 12 of the present invention is illustrated. The rippler 12 includes a leading end 66 and a trailing end 68. The leading end 66 defines a hook 70, structured to secure the rippler 12 to the plate 28. The trailing end 68 includes a ridge 72, structured to cause a ripple in a sheet of paper traveling over the ridge 72. In use, the rippler 12 will be placed upon each of the plates 28, with the hook 70 engaging the plate adjacent to the pulley 18, and the ridge 72 adjacent to the pulley 20. Although FIGS. 1-3 only illustrate a single rippler 12, it will be understood that using additional ripplers 12 is preferable, and that as many ripplers may be used as there are spaces between the belts 16.

Referring back to FIGS. 1-3, during a sheeting operation, paper being fed from a printing press after printing will proceed to a sheeter, which will cut it into appropriately sized sheets. After leaving the sheeter, it will be taken by the deliverer 10 to a stacker for forming appropriately sized stacks for storage and transportation. As a sheet of paper exits the sheeter, it will enter the deliverer 10 adjacent to the pulley 18, being transported by the vacuum belts 16 at a high rate of speed. Some embodiments of a deliverer using a rippler of the present invention may feed paper at speeds of up to 700 feet per minute using these first belts 16. As the sheet approaches the pulley 20, it will pass over the ridge 72, causing a ripple in the sheet corresponding to the ridge 72. The ripple will therefore be substantially parallel to the direction of travel of the sheet. With the paper bent in the manner forming this ripple, it will resist bending upwards, because bending the leading edge upward would bend the sheet substantially perpendicular to the ripples. The sheet thereby resists rising as it is fed by the belt 16 at this speed. As the sheet passes over the vacuum roller 42, one row of holes 52 will arrest the trailing edge of the sheet, slowing it down to a slower speed, which in some embodiments may be, for example, approximately five feet per minute. At this point, the sheet will most likely be almost entirely upon the previously fed sheet, with only the trailing edge protruding. The belt 60 will then transport the sheet to a stacker for stacking.

The present invention therefore provides a rippler for use with a paper deliverer, causing a ripple within a sheet of paper, thereby increasing the rigidity of that sheet of paper and resisting any tendency of the sheet to fly upward while being transported at a high rate of speed. The rippler of the present invention may be utilized with presently existing vacuum deliverers, being easily installed on these deliverers by placing the rippler 12 on top of the plate 28 and hooking the hook 70 onto these plates. The deliverer will therefore be capable of transporting paper at higher rates of speed, thereby increasing the productivity of the deliverer, and the sheeter to which the deliverer is secured.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A deliverer for a sheeter, the deliverer comprising:

a first set of vacuum belts, each belt within the first set having a pair of ends with a pulley at each end, and a plurality of apertures defined along the belts, and a vacuum chamber disposed below top surfaces of the first set of vacuum belts, structured to provide a suction through the apertures;

a vacuum roller disposed adjacent to one end of the first set of vacuum belts and substantially parallel to the pulleys of the first set of vacuum belts, the vacuum roller defining a pair of ends, a hollow interior, and at least one row of apertures, each row of apertures extending axially down a length of the vacuum roller, the vacuum roller further comprising a vacuum fitting in communication with the hollow interior;

a second set of vacuum belts disposed adjacent to the vacuum roller and coplanar with the first set of vacuum belts, each belt within the second set having a pair of ends with a pulley at each end, and a plurality of apertures defined along the belts; and a rippler disposed between at least some of the first set of vacuum belts, the rippler defining a ridge structured to cause a paper passing over the rippler to develop a ripple substantially parallel to a direction of movement within the deliverer, wherein the rippler is an elongated member having a hook for securing the rippler to a top plate of the deliverer.

2. The deliverer according to claim 1, wherein the top plate is located below the first set of vacuum belts, and wherein the vacuum chamber is defined by the top plate, a bottom plate, a plurality of end plates and a plurality of side plates.

3. The deliverer according to claim 1, wherein the rippler defines a pair of ends, with the hook disposed on one end, and the ridge disposed on the opposite end.

4. The deliverer according to claim 1, wherein the vacuum roller includes four rows of holes.

5. The deliverer according to claim 1, wherein the vacuum roller further comprises:

an outer rotating portion and an inner stationary portion, wherein the outer rotating portion defines the at least one row of apertures, wherein the inner stationary portion defines the hollow interior and includes a row of apertures provided therein, and wherein the row of apertures of the inner stationary portion extend axially down the length of the vacuum roller, with each of the apertures of the inner stationary portion corresponding to one aperture within each row of apertures defined within the outer rotating portion.

6. The deliverer according to claim 1, wherein a drive means for rotating an outer roller portion of the vacuum roller is provided.

7. The deliverer according to claim 5, wherein the inner stationary portion further comprises an insert within each of the apertures defined therein, the insert defining a hole therein, and being biased outward by a spring.

8. The deliverer according to claim 7, wherein each of the inserts is made from graphite.

9. The deliverer according to claim 5, further comprising an adjustment knob on the inner stationary portion.

10. The deliverer according to claim 5, wherein the vacuum fitting is secured at one end of the inner stationary portion.

11. A rippler for a paper deliverer having a top plate, the rippler comprising:

a ridge structured to cause a paper passing over the rippler to develop a ripple substantially parallel to a direction of movement within the deliverer, wherein the rippler is an elongated member having a hook that is structured to secure the rippler to the top plate of the deliverer with the hook located proximate to a pulley of the deliverer, wherein the rippler is structured to be disposed between at least some of a set of vacuum belts, and wherein the ripple in the paper is structured to increase the rigidity of the paper and resist being bent upward, wherein the deliverer further comprises:

a first set of vacuum belts, each belt within the first set having a pair of ends with a pulley at each end, and a plurality of apertures defined along the belts, and a vacuum chamber disposed below top surfaces of the first set of vacuum belts, structured to provide a suction through the apertures;

a vacuum roller disposed adjacent to one end of the first set of vacuum belts and substantially parallel to the pulleys of the first set of vacuum belts, the vacuum roller defining a pair of ends, a hollow interior, and at least one row of apertures, each row of apertures extending axially down a length of the vacuum roller, the vacuum roller further comprising a vacuum fitting in communication with the hollow interior; and a second set of vacuum belts disposed adjacent to the vacuum roller and coplanar with the first set of vacuum belts, each belt within the second set having a pair of ends with a pulley at each end, and a plurality of apertures defined along the belts, wherein the vacuum roller further comprises:

an outer rotating portion and an inner stationary portion, wherein the outer rotating portion defines the at least one row of apertures, wherein the inner stationary portion defines the hollow interior and includes a row of apertures provided therein, and wherein the row of apertures of the inner stationary portion extend axially down the length of the vacuum roller, with each of the apertures of the inner stationary portion corresponding to one aperture within each row of apertures defined within the outer rotating portion.

12. The rippler according to claim 11, wherein the rippler defines a pair of ends, with the hook disposed on one end, and the ridge disposed on the opposite end.

13. The rippler according to claim 11, wherein the vacuum roller includes four rows of holes.

14. The rippler according to claim 11, wherein the inner stationary portion further comprises an insert within each of the apertures defined therein, the insert defining a hole therein, and being biased outward by a spring.

* * * * *